United States Patent [19]

Tidstrom

[11] 4,038,906

[45] Aug. 2, 1977

[54] METHOD OF AND DEVICE FOR ACHIEVING A RAPID TRANSFER IN A TANK OF A ROUND FROM A MAGAZINE TO THE RAMMING POSITION AT THE FIREARM OF THE TANK

[75] Inventor: Bror Erling Tidstrom, Karlskoga, Sweden

[73] Assignee: AB Bofors, Bofors, Sweden

[21] Appl. No.: 616,098

[22] Filed: Sept. 23, 1975

[30] Foreign Application Priority Data

Oct. 18, 1974 Sweden ..... 74131269

[51] Int. Cl.[2] ..... F41H 7/06

[52] U.S. Cl. ..... 89/46; 89/47

[58] Field of Search ..... 89/33 A, 34, 36 H, 40 B, 89/45, 46, 47

[56] References Cited

U.S. PATENT DOCUMENTS

| | | | |
|---|---|---|---|
| 3,015,254 | 1/1962 | Leathers et al. | 89/41 CE |
| 3,122,967 | 3/1964 | Johnson et al. | 89/46 |
| 3,763,741 | 10/1973 | Rieke | 89/33 A |
| 3,884,119 | 5/1975 | Zouck | 89/45 |

FOREIGN PATENT DOCUMENTS

| | | | |
|---|---|---|---|
| 26,922 | 5/1916 | Norway | 89/45 |

*Primary Examiner*—Stephen C. Bentley
*Attorney, Agent, or Firm*—Pollock, VandeSande & Priddy

[57] ABSTRACT

A round is rapidly transferred from a magazine, located at a fixed position on the chassis of a tank, to a ramming position adjacent a traversable firearm mounted in a turret on the tank, by use of a loading trough which is actuated by a hydraulic cylinder to transport a round from the magazine to a round cradle. The round cradle is rotatable about an axis extending at right angles to the traversing plane of the firearm, is located in a predetermined feeding position relative to the magazine for receiving the round delivered by the loading trough, is thereafter rotated through an angle to orient the cradle and round thereon to a position coinciding with the prevailing traverse position of the firearm, whereafter gripping members are activated to move the round from the cradle to the ramming position adjacent the firearm.

12 Claims, 9 Drawing Figures

METHOD OF AND DEVICE FOR ACHIEVING A RAPID TRANSFER IN A TANK OF A ROUND FROM A MAGAZINE TO THE RAMMING POSITION AT THE FIREARM OF THE TANK

The present invention relates to a method of and a device for achieving a rapid transfer in a tank of a round from a magazine located at a fixed position in the tank chassis to a ramming position at a firearm associated with the tank and traversable in relation to the tank chassis and the magazine.

In a tank which has a firearm mounted in the tank chassis the barrel fo which is traversable in relation to the tank chassis, there are problems involved in being able to maintain a high rate of fire, regardless of the traverse position of the firearm, without the necessary devices for automatic transfer of the round becoming altogether too complicated.

The present invention is concerned with these problems, and provides a method of and a device for permitting a high rate of fire which is not dependent on the traversing, notwithstanding a technically simple design.

The feature that can mainly be considered to be characteristic of a method according to the invention is that the respective round is transferred to a round cradle (or corresponding means) which is rotatable in the traversing plane, around or together with a shaft extending at right angles to the traversing plane and which, at the time of feeding of the respective round from the magazine, is set in a feeding position. The cradle is thereafter oriented to a position coinciding with the prevailing position of the firearm in traverse, and gripping members which can coact with the round are activated for moving the round from the cradle to the ramming position at the firearm. A device for carrying out the new method is characterized by a round cradle (or corresponding means) which is rotatable in the traversing plane, around or together with a shaft extending at right angles to the traversing plane and which can be set in a feeding position allotted to the rounds and in all traverse positions of the firearm which occur, and by gripping members which for onward transportation of the respective round can coact with the round placed in the cradle assumes its position in traverse which coincides with the traversing of the firearm.

Figure 4:
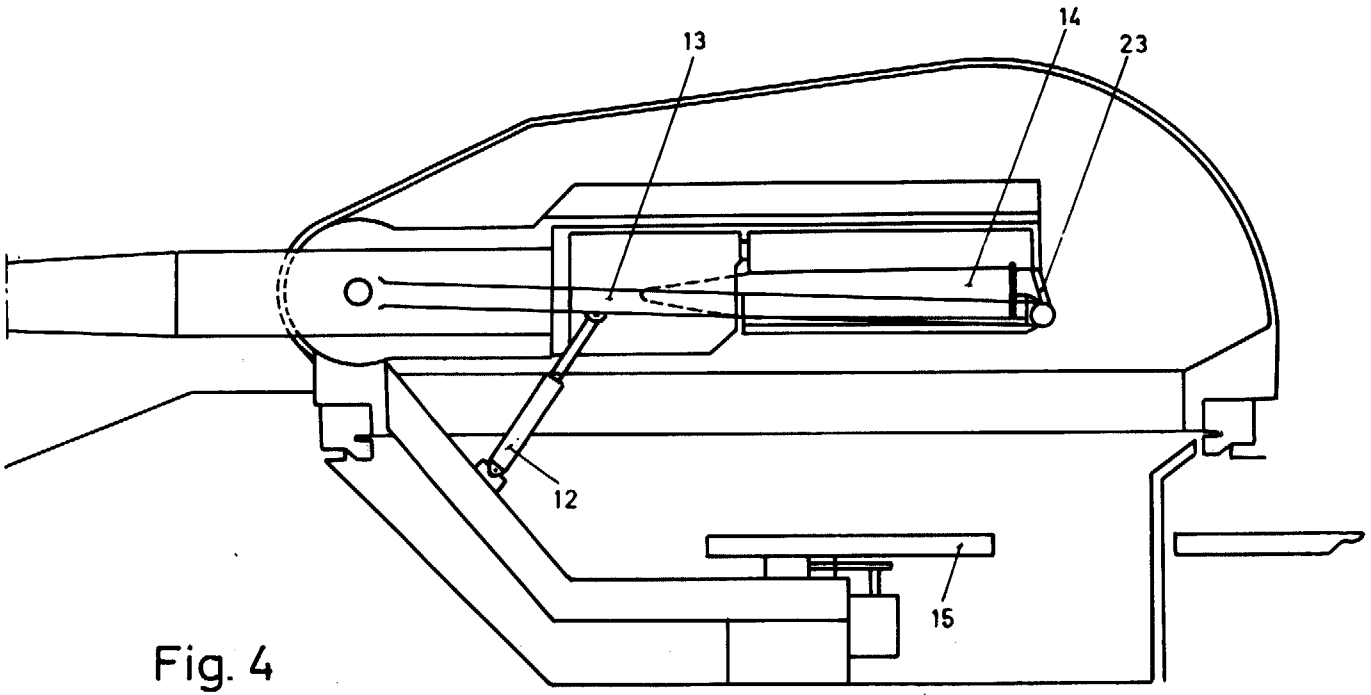
Figure 5:
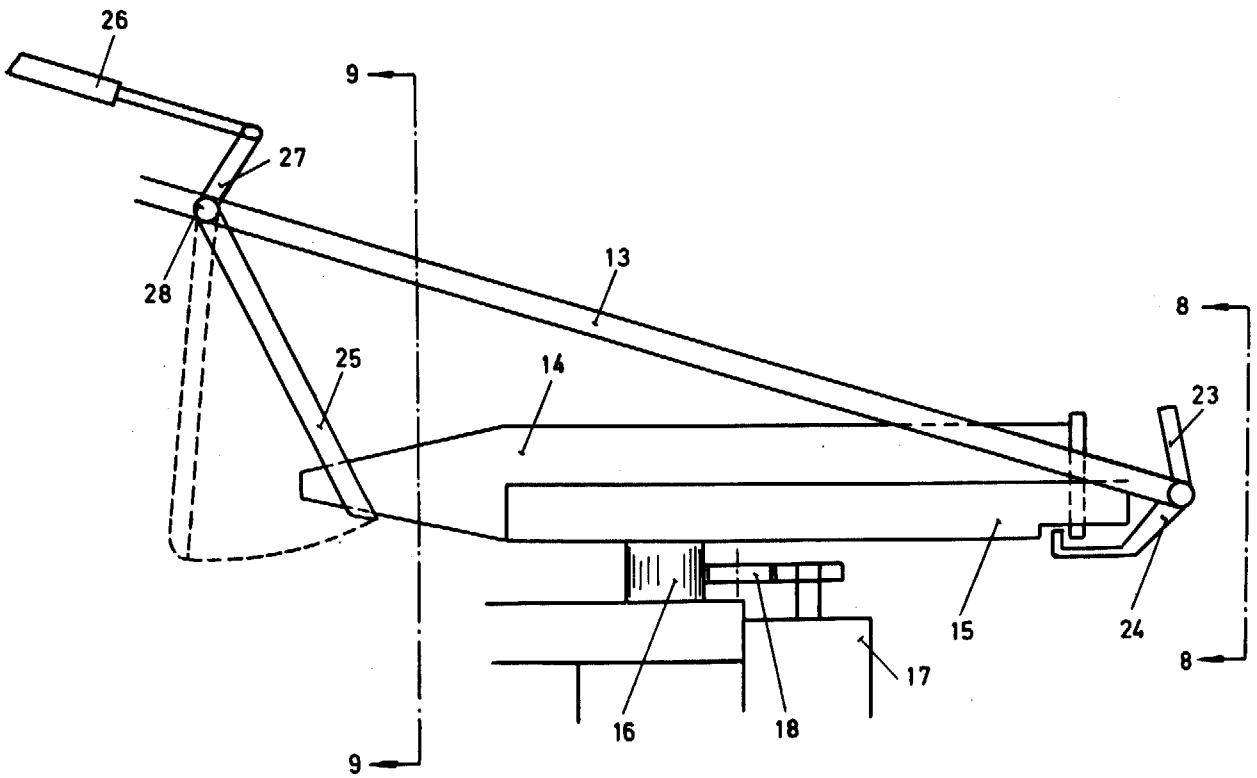
Figure 6:
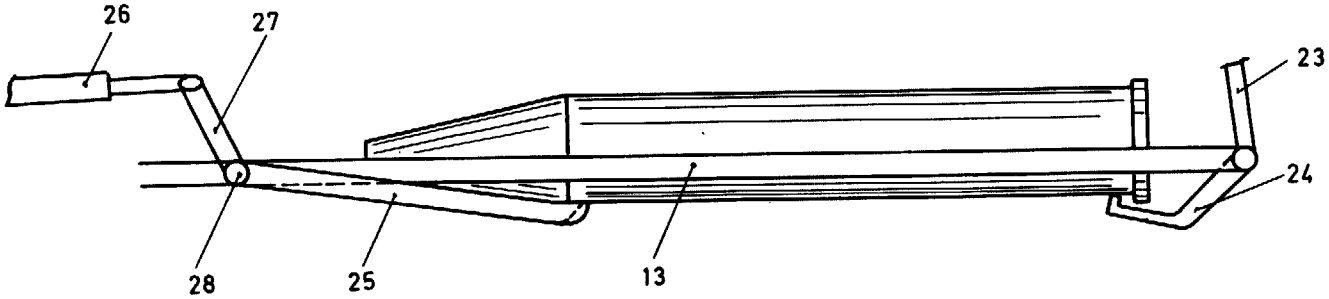
Figure 8:
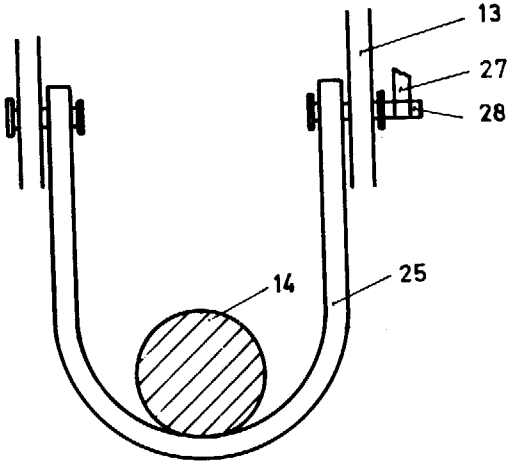
Figure 7:
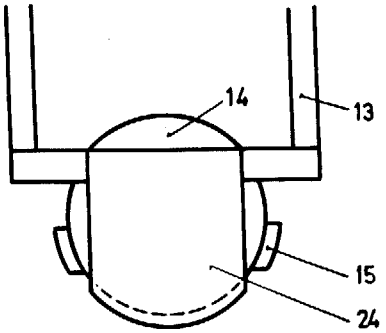
Figure 9:
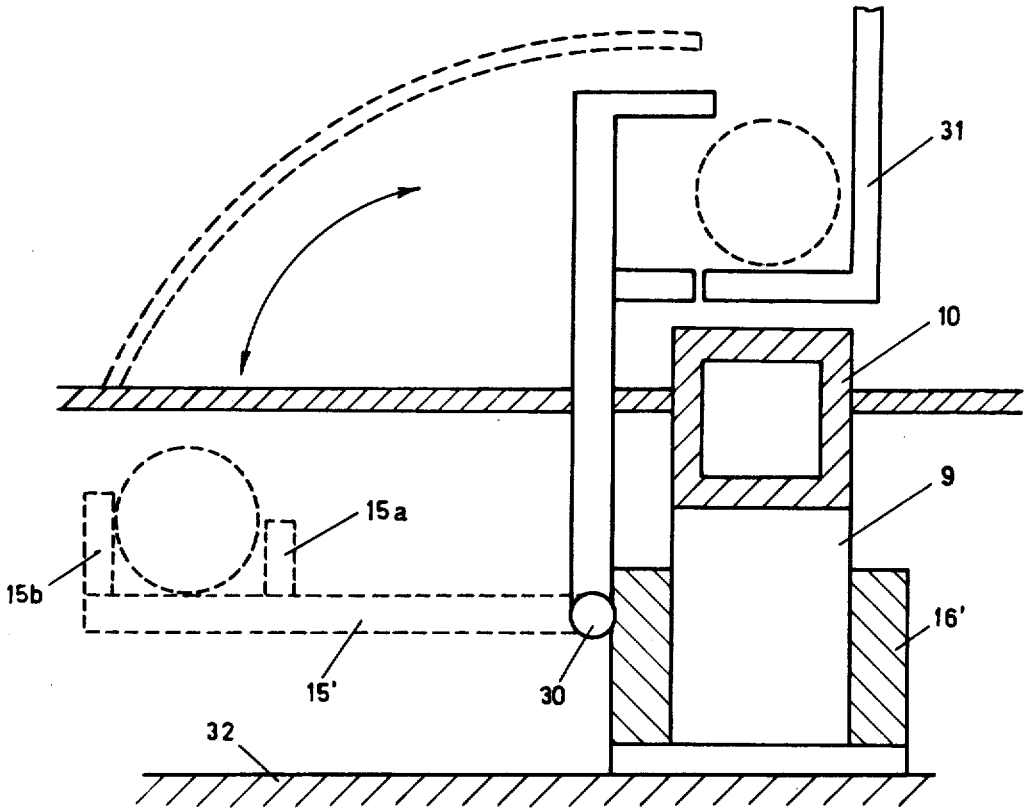

Embodiments proposed at present of a device having the characteristics significant for the invention will be described in the following, with reference to the accompanying drawings, in which FIG. 1 in a vertical view partly shows the upper parts of a turret tank and a first embodiment of the invention, FIG. 2 in a vertical view shows the parts of the tank according to FIG. 1, but in a subsequent functioning stage of the transfer of the round, FIG. 3 in a horizontal view shows a further functioning case compared with FIGS. 1 and 2, FIG. 4 in a vertical view shows the parts according to FIG. 1, but in a stage following the functioning stage according to FIG. 2, FIG. 5 in a vertical view and in an enlargement shows the parts comprised in FIG. 2, FIG. 6 in a vertical view shows a functioning stage for the transfer of a round separate from FIG. 5, FIGS. 7 -8 show, simplified, cross-sections of the devices according to FIG. 5, and FIG. 9 in a vertical section shows a second embodiment of the parts comprised in FIG. 5.

Figure 1:
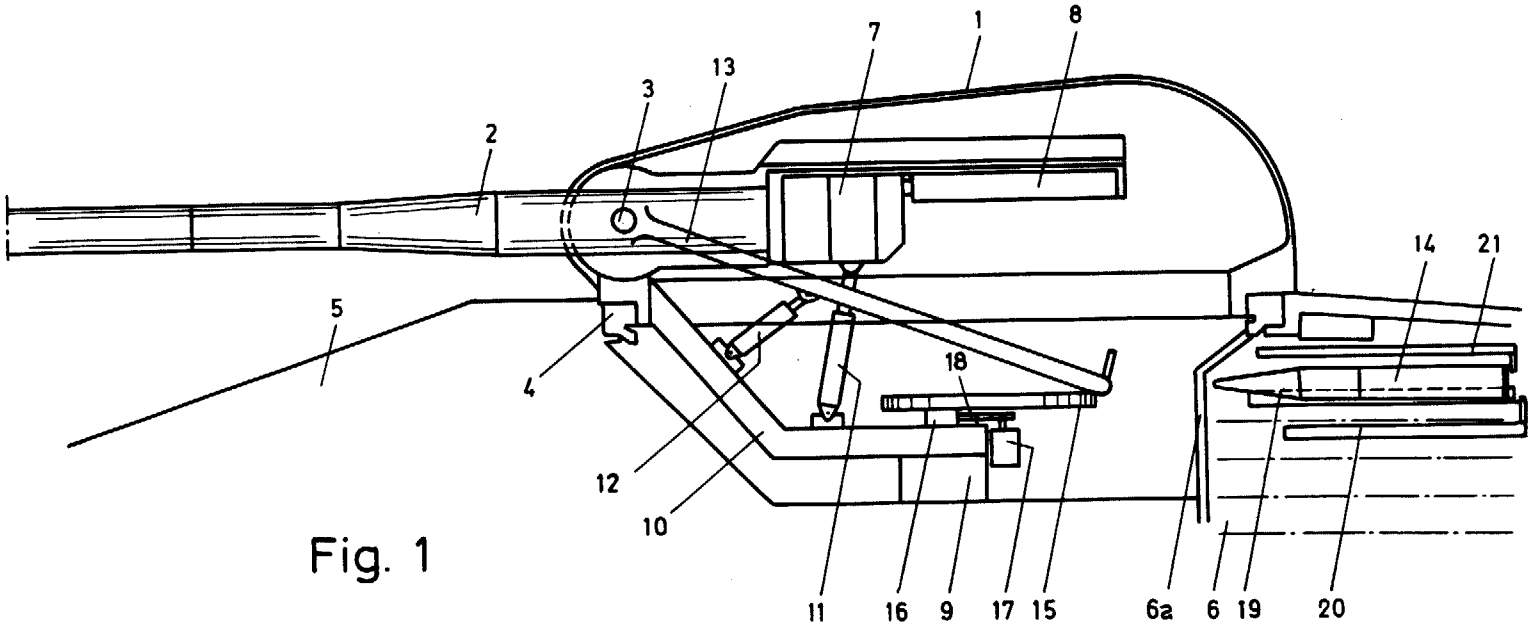

FIG. 1 shows the upper parts of a tank provided with a turret, 1 having a gun barrel 2 supported so that it can be elevated and depressed. The gun, which can consist of, for instance, a high-pressure gun with a calibre of 105 mm, is supported in the front parts of the turret in a trunnion 3, in a way which is known in itself. The turret 1 is moreover rotatable on a ring 4 in relation of the tank chassis 5, in which also a magazine 6 is mounted in a fixed position in relation to the rotatable turret 1. For the sake of clearness, the breech ring 7 of the firearm is shown with the recoil jacket removed. The firearm is provided with a recoil buffer and recuperator 8, and between these is provided a rammer, not shown, of a kind which is known in itself. For the transmission of electric power from the source of power of the tank, not shown, between the fixed tank chassis and the movable turret, in the middle of the floor, there is a slip-ring gear 9, also of a kind which is known in itself. In the turret 1, there is also a mounting beam 10, which has one end fastened on the slip-ring gear 9 and which turns with the traversing movements of the turret 1 . Said beam 10 constitutes a fastening member for control equipment, of which is shown inter alia only a hydraulic cylinder 11 for the elevation and depression movements of the firearm, and a hydraulic cylinder 12 for automatic control of a pendulum arm 13, which is used in the loading function and 2 which is rotatably supported on the trunnion 3 of the barrel 2. The pendulum arm 13 can be made in the form of a single arm supported at one side of the barrel or, alternatively, can comprise a pair of arms which are respectively supported on both sides of the barrel. In the figure there is shown a round 14, in the magazine 6, which round is to be transferred rapidly from the magazine to a ramming position at the firearm. The magazine 6 is screened off with a heavy armoured wall, in which there is an opening, not shown, for the round.

According to the invention, the transfer of the round is effected by means of a round cradle 15, which is arranged rotatably on or with a shaft 16, which extends at right angles to the traversing plane of the firearm. In the example of the embodiment, the round cradle 15 is located inside the turret 1, at the floor, and it is rotatable together with the shaft 16 which, in turn, is turned with the aid of a hydraulic motor 17, the movements of which are transmitted to the shaft 16 via a gear 18. In the magazine 6, the round 14 is placed on a loading trough 19, which can be displaced in its longitudinal direction by means of a hydraulic cylinder 20. On the loading trough 19, or fixed in relation to the movement thereof there is also fitted a further hydraulic cylinder 21, by means of which the round 14 can automatically be pushed off of the loading trough 19 over to the round cradle 15 when the loading trough has been moved by the cylinder 20 towards the round cradle so that it has one end adjoining one end of the round cradle 15. As described in the following, the pendulum arm 13 is made with gripping members which can automatically grip a round transferred into the round cradle 15 and move it in a line where it can be swung to the ramming position by the pendulum arm 13.

Figure 2:
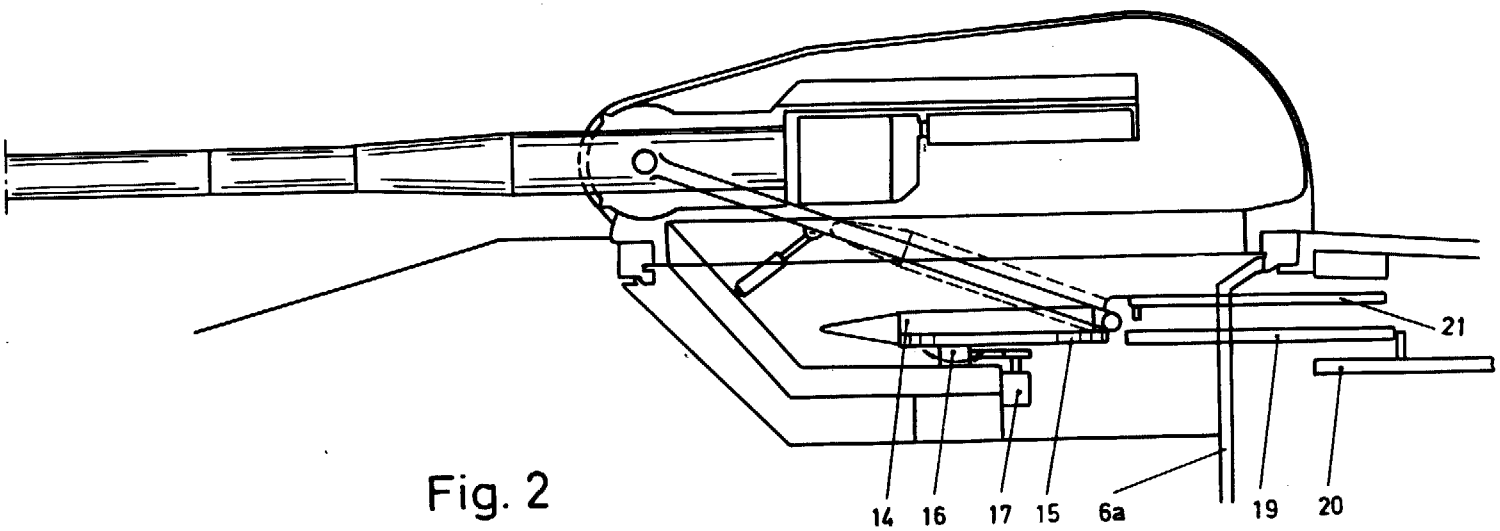

As shown in FIG. 2, the round 14 has been transferred to the round cradle 15 only after the loading trough 19 has been displaced longitudinally by the cylinder 20 partly out through the opening in the wall 6a whereafter the round 14 is pushed by the cylinder 21 onto the round cradle to the position shown with solid lines in FIG. 2. The round 14 is thereafter to be actuated by the gripping members to the position shown with the dash lines. At the transfer of the round 14 from the magazine 6 to the round cradle 15, the round assumes a feeding position which coincides with an angle of traverse of 0° for the barrel in relation to the tank chassis. In case the firearm, after the round 14 has been transferred to the round cradle 15 assumes a position in traverse other than 0°, the round cradle 15 is first turned by means of the shaft 16 in the traversing plane so that it assumes a position in traverse corresponding to the traverse position of the firearm before the pendulum arm 13 and the associated gripping member are moved to coact with the round on the cradle. The turning function, which is carried out by the motor 17, can be performed automatically and can be initiated, for example, by microswitches on the front parts of the round cradle 15, which are actuated when the entire round 14 has been transferred on to the cradle 15. Stops referable to the rear parts of the firearm are then arranged so that the turning movement will cease when the round cradle 15 has come into a traverse position coinciding with that of the firearm.

Figure 3:
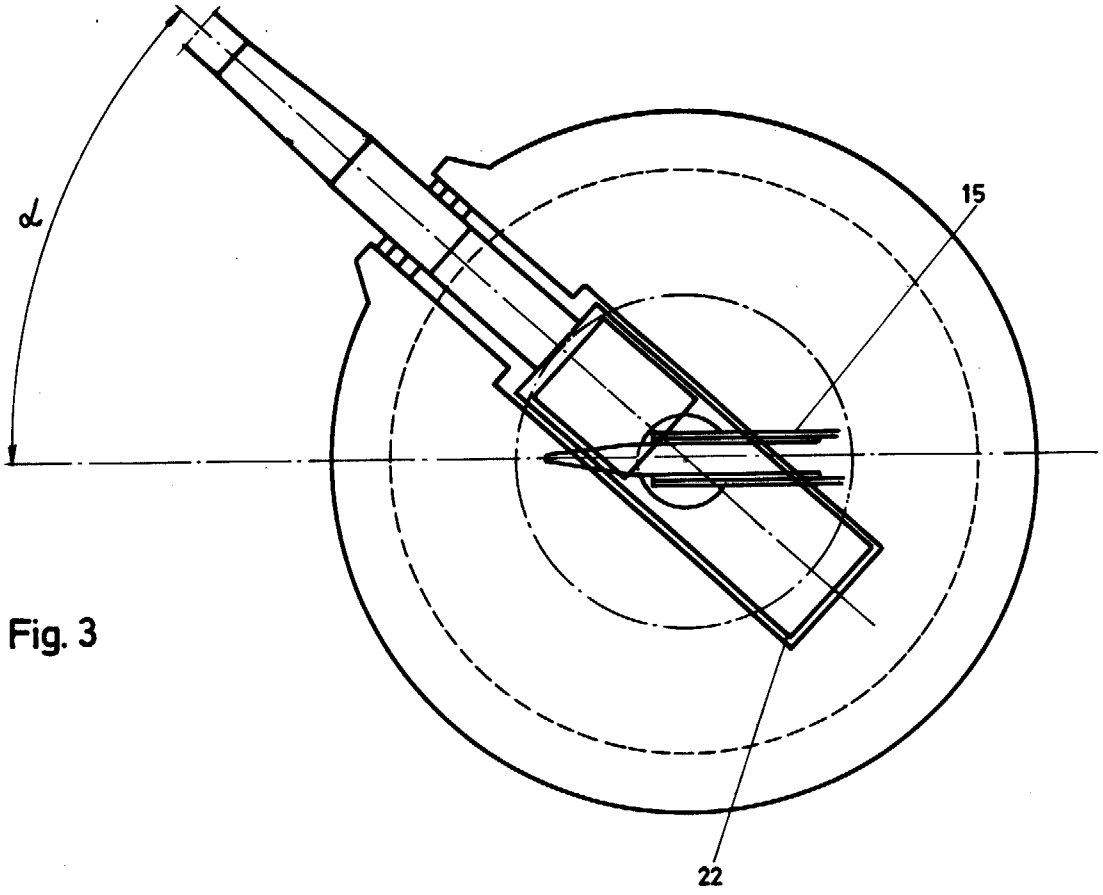

FIG. 3 is intended to illustrate the case when the round cradle 15 is in its feeding position, but the firearm is turned to an angle of traverse $\alpha$. The round cradle 15 must thus to be turned through an angle $\alpha$ before the pendulum arm 13 and its gripping members are activated. In FIG. 3 the recoil jacket 22 is shown, but for the sake of clearness the pendulum arm has not be indicated.

FIG. 4 shows the ramming position for the round 14 after it has been moved up by the pendulum arm 13 from the position shown with dash lines in FIG. 2. Durnig this raising movement, the round cradle 15 is given a return movement to the feeding position, so that a new round on the loading trough 19 in the magazine 6 can be transferred to the round cradle 15. The return movement is initiated by means of actuating members not shown, which are controlled either from the movement of the pendulum arm 13 or from said microswitches on the front parts of the round cradle 15. If the movement of the loading trough 19 is regarded, it will be noted that the loading trough returns to its fetching position in the magazine 6 as soon as a round 14 has been transferred to the round cradle 15, which return is controlled by microswitches on the trough 19 and is carried out by means of the cylinder 20. Said microswitches on the loading trough can also control the movement achieved with the cylinder 12 to the ramming position for the arm 13.

In the ramming position according to FIG. 4, the holding of the round is taken over by members at the firearm, and therefore the gripping members on the pendulum arm 13 must be released, so that these will release the round. In the example of the embodiment, the gripping members can coact with the front and rear parts of the round. For the releasing of the gripping members at the rear parts, the pendulum arm 13 has a releasing device 23 which can be actuated by means of the rammer on the firearm.

FIGS. 5–8 show an example of gripping members on the pendulum arm 13. The gripping members comprise a catch 24, at the free end of the arm 13, which can coact with the rear flange of the round. The catch 24 is spring-loaded, or can be actuated by means of a hydraulic cylinder not shown, and is arranged so that it can be actuated by the releasing device 23 in the ramming position according to FIG. 5 so that the releasing function can take place. At the upper end of the pendulum arm, the arm 13 is provided with a rotatably supported yoke 25, which can be controlled by hydraulic cylinder 26 for coaction with the round 14 placed in the round cradle 15. When the yoke 25 has been put into contact with the round by the cylinder 26, at the point of the round, this can be tipped by means of the yoke around the catch 24 so that it assumes the position shown in FIG. 6. The catch is then arranged so that at the tipping movement it will carry out a slight accompanying angular movement so that the positioning of the round 14 parallel to the pendulum arm 13 which is desired, will take place. The transfer from the cylinder 26 takes place via a link arm 27 which is fixed in relation to the yoke 25 at its supporting point 28.

As an alternative to the yoke and catch as gripping members, the gripping members can be made strictly as gripping jaws, which grasp the sides and rear parts of the round. It is also possible to make the round cradle 15 so that it can be tipped in relation to the traversing plane, so that after its setting in traverse position it can be set in an inclined position coinciding with the inclination of the pendulum arm 13.

In the example shown, the mounting beam 10 is below the feeding opening in the wall **6*a*, which means that the beam in a certain traversing position will obscure said feeding opening. In an alternative embodiment according to FIG. 9, in order to eliminate this problem, the mounting beam 10 can be arranged above the feeding opening, so that the opening will be unobscured in all traverse positions. The round cradle 15' must then be arranged at the side of the slip-ring gear 9, which is connected with the mounting beam 10. This involves that the round cradle 15', in addition to being rotatable for adaptation to the traverse position, is also arranged so that it can be lifted over the mounting beam 10 while being displaced laterally at the same time, so that the round will come in line with the barrel. In FIG. 9 the support for the round cradle in the traversing is symbolized with 16', while the lifting and lateral displacement movements are achieved by means of a supporting shaft extending at right angles to the plane of the figure. In this case, the round cradle is equipped with two side parts 15*a* and 15*b*, which hold the round in place during the rotating movement of the cradle from the position shown with dash lines in FIG. 9 to the position shown with solid lines, from where the round can be rolled over to a pendulum or hoist which is illustrated at 31. The floor of the tank is designated 32**. At its lateral movement, the round will follow the arc of a quarter circle.

A method of achieving a rapid transfer in a tank of a round from a magazine with a fixed position in the tank chassis to a ramming position at a traversable firearm belonging to and relative to the tank chassis and magazine can be illustrated by the following example. A round which is to be used is first transferred to a loading trough in the magazine, after which the loading trough is displaced in its longitudinal direction with a hydraulic cylinder so that the loading trough will be end to end with a round cradle which is rotatable on or with a shaft extending at right angles to the traversing plane. The round is transferred from the trough to the cradle by a further hydraulic cylinder, which is fixed in relation to the movement of the trough. The round cradle is thereafter given a rotating movement in the traversing plane until it is halted by means of stops or corresponding means in a traverse position corresponding to the traverse position of the firearm. During this time, the loading trough is caused to return to its fetching position in the magazine, to fetch a new round. Said movement to the fetching position is carried out by means of said longitudinal displacement cylinder for the loading trough.

When the round cradle has reached the position coinciding with the traverse position of the firearm, automatically controlled gripping members are activated, by means of which the round is swung up into a ramming position. The gripping members can be comprised in a hoisting device or a pendulum arm supported on the trunnion of the barrel. When the gripping members have come into coaction with the round and have gripped the round, the round cradle is returned to its feeding position. When the gripping members have moved the round to the ramming position, they are released by means of actuating devices on, for instance, the firearm, after which a return can take place for coaction with a new round inserted in the round cradle from the loading trough. Said functions can be coordinated to a high degree, so that the transfer of rounds takes place within the optimum time, which gives the firearm a high rate of fire.

In a further development for a certain type of tanks, the round cradle is made so that it not only can be rotated according to the traverse position of the firearm on a shaft extending at right angles to the floor of the turret, but also so that from the feeding position it can lift the round upwards, at the same time as the entire round is displaced transversally. After the transfer of the round from the loading trough, the round is then given its traversing movement, after which the movement for the raising and transversal displacement is initiated so that the round cradle is lifted over a mounting beam extending in and used inside the turret.

The invention is not limited to the embodiments shown above as examples, but can be subject to modifications within the scope of the following claims.

I claim:

1. In a tank, a magazine having elongated rounds stored therein, said magazine being located at a fixed position relative to the tank chassis, means defining a loading space in said tank, said means including a wall in said tank separating said magazine from said loading space, said wall having an opening therein through which rounds may be individually transferred, a firearm on said tank for firing said rounds, said firearm having a breech ring and an elongated barrel which is mounted for traversing movement in a first azimuth plane, said firearm being supported on trunnions for selective elevation of said barrel relative to said chassis whereby said first azimuth plane is variably inclinable relative to a second azimuth plane, and a device for effecting rapid transfer of a round from said magazine to a ramming position adjacent the breech ring of said firearm, said device comprising an elongated round cradle located in said loading space in spaced relation to said magazine at a position below and to the rear of the breech ring of said firearm, said elongated round cradle being mounted for elevational movement and also being mounted for rotation in said second azimuth plane about an axis transverse to said first azimuth plane of said firearm, means for setting said cradle into a predetermined feeding position relative to said magazine, one end of said elongated cradle being disposed in facing relation to said opening in said wall when said cradle is in its said feeding position, feeding means for transferring a round from said magazine through said opening along the direction of elongation of said round onto said elongated round cradle when said cradle is in its said feeding position, drive means for thereafter rotating said cradle in said second azimuth plane about said axis to angularly reposition said elongated round into a third plane which is oriented at right angles of each of said first and second azimuth planes and which passes through the center line of said elongated barrel, and gripping means operative subsequent to operation of said drive means for engaging said repositioned round to move said round along said third plane away from said cradle and into said ramming position adjacent the breech ring of said firearm.

2. The structure of claim 1 wherein the axis of rotation of said cradle is defined by a rotatable shaft connected to said cradle and extending below the bottom of said turret.

3. The structure of claim 1 wherein said trunnions are located adjacent the front of a turret, said magazine being located to the rear of said turret.

4. The structure of claim 1 wherein said gripping means are affixed to said firearm for movement therewith.

5. The structure of claim 4 wherein said gripping means comprises at least one elongated arm one end of which is pivotally attached to the trunnion of the barrel of said firearm, the other end of said arm being located adjacent said cradle when said arm is in a fetching position, and means for selectively pivoting said arm about its said one end to move said other end of said arm away from said cradle thereby to place said arm in a ramming position relative to said firearm.

6. The structure of claim 5 wherein said lastnamed means comprises a hydraulic cylinder.

7. The structure of claim 5 including catch means on said other end of said arm adapted to engage the rearward end of a round on said cradle when said arm is in said fetching position.

8. The structure of claim 7 including means for releasing said catch means from said round when said arm is in said ramming position.

9. The structure of claim 7 including releasable engaging means carried by said arm for engaging the forward end of a round on said cradle when said arm is in said fetching position, and means for releasing said engaging means when said arm is in said ramming position.

10. The structure of claim 1 wherein said round cradle is mounted for lateral displacement.

11. In a tank, a magazine having elongated rounds stored therein, said magazine being located at a fixed position relative to the tank chassis, a firearm on said tank for firing said rounds, said firearm having a breech ring and an elongated barrel which is mounted for traversing movement in a first azimuth plane, and a device for effecting rapid transfer of a round from said magazine to a ramming position adjacent the breech ring of said firearm, said device comprising a round cradle located within the tank in spaced relation to said magazine at a position below and to the rear of the breech ring of said firearm, said cradle being mounted for rotation in a second azimuth plane about an axis transverse to said first azimuth plane of said firearm, means for setting said cradle into a predetermined feeding relative to said magazine, feeding means for transferring a round from said magazine along the direction of elongation of said round onto said cradle when said cradle is in its said feeding position, drive means for thereafter rotating said cradle in said second azimuth plane about said axis to angularly reposition said elongated round into a third plane which is oriented at right angles of each of said first and second azimuth planes and which passes through the center line of said elongated barrel, and gripping means operative subsequent to operation of said drive means for engaging said repositioned round to move said round along said third plane away from said cradle and into said ramming position adjacent the breech ring of said firearm, said feeding means comprising an elongated loading trough mounted for longitudinal movement between said magazine and said round cradle, and hydraulic cylinder means for selectively moving said trough longitudinally to transport a round from said magazine to said cradle.

12. The structure of claim 11 including further hydraulic cylinder means for moving a round from said trough onto said cradle.

* * * * *